US006155150A

United States Patent [19]

Cooper et al.

[11] Patent Number: 6,155,150

[45] Date of Patent: Dec. 5, 2000

[54] HYDRAULIC TUBING PUNCH AND METHOD OF USE

[75] Inventors: Gary E. Cooper, Conroe; Larry Thomas Palmer, Houston, both of Tex.; Jonathan Price, Pescara, Italy

[73] Assignee: Baker Hughes Incorporated, Houston, Tex.

[21] Appl. No.: 09/124,816

[22] Filed: Jul. 29, 1998

[51] Int. Cl.[7] ..... B26F 1/24

[52] U.S. Cl. ..... 83/13; 83/30; 83/188

[58] Field of Search ..... 83/30, 691, 651, 83/647, 188; 72/323, 22

[56] References Cited

U.S. PATENT DOCUMENTS

| | | | |
|---|---|---|---|
| 1,785,419 | 12/1930 | Moss . | |
| 2,457,277 | 12/1948 | Schlumberger | 166/1 |
| 2,482,913 | 9/1949 | Jobe | 166/1 |
| 3,301,337 | 1/1967 | Vaughn et al. | 175/22 |
| 4,497,351 | 2/1985 | Garcia | 141/329 |
| 4,640,362 | 2/1987 | Schellstede | 166/298 |
| 4,765,173 | 8/1988 | Schellstede | 72/325 |
| 4,928,757 | 5/1990 | Schellstede | 166/55.1 |
| 5,183,111 | 2/1993 | Schellstede | 166/298 |

OTHER PUBLICATIONS

Baker Oil Tools Technical Manual; *Control Pressure Penetrator;* Feb. 4, 1994; pp. 1–6.

Kinley StadardPerforator/Senior Perforator catalog sheet; publication date unknown, but more than one year prior to filing date; p. 2199.

Penetrators, Inc. Tech Report; *Lance Formation Penetrator Tool;* Sep. 18, 1988; one page.

*Primary Examiner*—Lee Young
*Assistant Examiner*—Sean Smith
*Attorney, Agent, or Firm*—Gerald W. Spinks

[57] ABSTRACT

An apparatus and method for driving a ramped drive assembly longitudinally, to drive a penetrator transversely, to cause the penetrator to penetrate and withdraw from a downhole tubular element. An anchor holds the tubing punch assembly in place in the downhole tubular element. A double piston assembly drives the drive assembly hydraulically in the downhole direction, thereby driving the ramp downhole, to force the penetrator outwardly to penetrate the tubular element. Thereafter, pulling uphole on the work string shears a shear sleeve, separating the housing of the tubing punch assembly from the work string. Further pulling on the work string partially withdraws the ramped drive assembly from the tubing punch assembly, thereby withdrawing the penetrator into the tubing punch assembly.

17 Claims, 6 Drawing Sheets

HYDRAULIC TUBING PUNCH AND METHOD OF USE

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention is in the field of methods and apparatus used to punch holes through, or place fittings or markers in, downhole tubular elements, such as casing pipe.

2. Background Information

In the completion of oil wells, and the production of oil from such wells, it can often become necessary or beneficial to punch one or more holes through, or perforate, the casing which lines the well bore, or the production tubing within the casing. These perforations can have several purposes, such as the creation of a gas lift flow path, the production of different zones or different formations from the well bore, the creation of a circulation path to kill the well, the loosening of sand or mud between the production tubing and the casing, or the placement of an orifice, check valve, or marker in the production tubing or casing. Further, such perforations can be used to create a circulation path to squeeze cement around a leaking packer element or perforation, or to create a circulation path for use in other remedial work, such as stimulation. A tool used for this purpose will ideally be able to be positioned within a highly deviated or even horizontal well bore, it will reliably and safely generate sufficient power to puncture thick walled tubing or casing, it will give the operator a positive indication of complete penetration of the tubing or casing, and it will reliably withdraw completely from the tubing or casing without hanging up.

Some tools are available for puncturing tubing, using either a burn-through technique, or a mechanical punch driven by a jarring tool, for creation of the penetration. These tools are typically carried by a wireline. None of the known tools exhibit the ideal attributes listed above. Wireline tools can not be positioned reliably in highly deviated holes. Burn-through tools and jar driven punches do not give reliable indications of complete and uniform penetration, and they are sometimes subject to hanging in the perforation, making withdrawal difficult or impossible.

BRIEF SUMMARY OF THE INVENTION

The present invention is a hydraulically driven punch which generates sufficient, smoothly applied, power to penetrate thick walled tubing and casing. Conveyed on a tubular work string, the punch can be positively positioned at any desired location in a deviated or horizontal well bore before activation. Full penetration is positively signalled to the operator. Withdrawal is positive, and full withdrawal is achieve prior to lifting of the tool, virtually preventing hangup.

In the preferred embodiment, a drive assembly, consisting of two stacked pistons and a plunger, moves longitudinally to drive a penetrator element transversely into the production tubing or casing. The housing of the hydraulic tubing punch of the present invention consists of a piston housing and a plunger housing, connected by a releasable sub. The piston housing contains the two stacked hydraulic pistons. The upper piston applies force to the center of the lower piston by means of an upper piston rod. The lower piston is connected by a lower piston rod to the plunger, which is located in the plunger housing. The plunger incorporates a pair of oppositely facing ramped surfaces, angled slightly relative to the longitudinal axis of the tool. The ramped surfaces on the plunger mate with similarly angled surfaces on a penetrator element which can move transversely relative to the longitudinal axis of the tool. In the preferred embodiment, the oppositely facing ramped surfaces on the plunger comprise at least one groove, and the mating surfaces on the penetrator element comprise at least one ridge. The penetrator element incorporates an outwardly oriented punch of hard, durable material, capable of penetrating the production tubing or casing.

Application of high pressure drilling fluid or other hydraulic pressure to the upper surface of the upper piston drives it downwardly to cause its piston rod to exert downward force on the lower piston. Throughout this specification, the term "downward" will be used to mean "downhole", and "upward" will mean "uphole", even though in some applications the tool will be located in a highly deviated or horizontal well bore. Simultaneous application of hydraulic pressure to the upper surface of the lower piston also forces it downwardly. Downward travel of the lower piston is accompanied by downward travel of the plunger. As the ramped surfaces on the plunger move longitudinally downwardly, they cause the penetrator element to move transversely outwardly, which causes the punch portion of the penetrator element to exit through a window in the plunger housing and punch through the wall of a production tube or a casing surrounding the hydraulic tubing punch tool. A support dog, radially opposite the punch portion of the penetrator element, is forced radially outwardly, simultaneously with, or just prior to, the transverse travel of the penetrator element. The support dog bears against the opposite side of the production tubing or casing to maintain the tubing punch tool axially aligned with the tubing or casing. Additional support dogs can be used to further stabilize the axial alignment of the tool.

A bleed port is positioned in the piston housing, at a location just above the full travel position of the upper piston. As the upper piston reaches its full travel position, the bleed port is uncovered, allowing the hydraulic fluid to exit from the interior of the tubing punch to the annulus surrounding the tool. This reduces the hydraulic pressure applied to the pistons, and the pressure drop is seen by the operator at the surface of the well site, signalling full travel of the upper piston. Because of the rigid connection between the pistons and the plunger, full travel of the upper piston is accompanied by substantially full transverse travel of the penetrator element, thereby ensuring full penetration of the production tubing or casing.

The work string is then pulled upwardly, with the first upward movement of the work string causing the piston housing to separate from the plunger housing at the releasable sub. Release can be accomplished by shearing a shear pin in the releasable sub upon pulling up on the work string, or by releasing a release dog in the releasable sub upon full downward travel of the lower piston. In either case, pulling of the work string continues upwardly, pulling the piston housing, the pistons, and the plunger upwardly. This upward pulling of the plunger causes the ramped surfaces to pull the penetrator element transversely inward, withdrawing the punch from the tubing or casing. If desired, a fitting, such as an orifice, check valve, or marker tag, can be releasably mounted on the punch, to be left in the tubing or casing upon withdrawal of the punch into the plunger housing. After full retraction of the punch from the tubing or casing, a support profile on the plunger contacts a mating profile on the plunger housing, to enable withdrawal of the plunger housing from the well bore, along with the rest of the tool.

An anchor mechanism can be provided to anchor the tubing punch tool within the well bore at any selected location. The anchor mechanism can be hydraulically set, and mechanically released by upward pulling on the work string.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
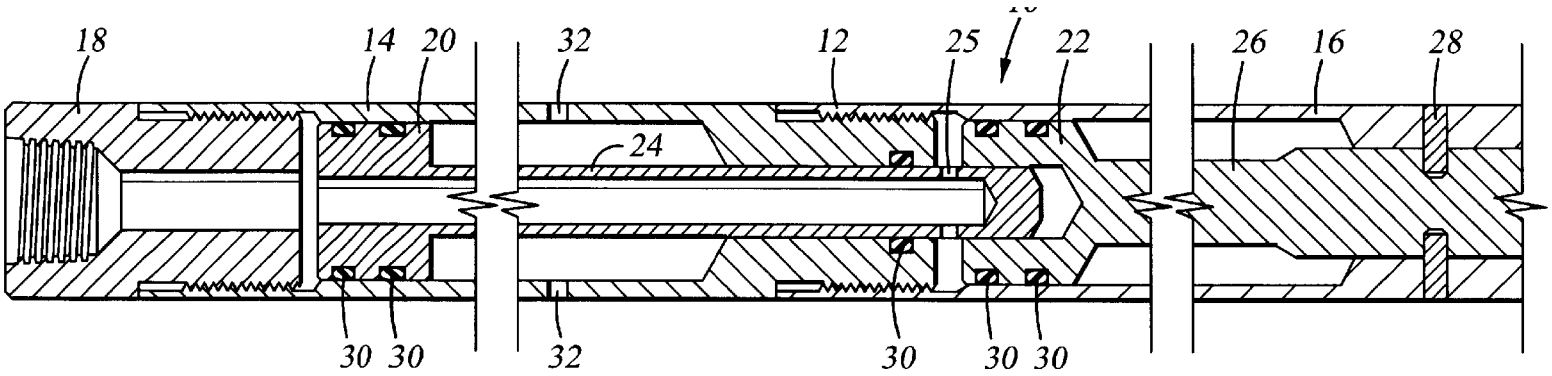
FIG. 1 is a longitudinal section view of the piston housing of a first embodiment of the hydraulic tubing punch tool of the present invention, before longitudinal travel of the drive assembly.

As seen in FIG. 1, a first embodiment of the hydraulic tubing punch tool 10 of the present invention includes a piston housing 12, which preferably consists of an upper piston housing 14 threaded to a lower piston housing 16. An upper connector sub 18 is threaded to the upper end of the upper piston housing 14, for connecting the hydraulic tubing punch tool 10 to a work string, such as a drill pipe or coiled tubing (not shown). An upper piston 20 is slidably mounted within the upper piston housing 14 for longitudinal movement. A lower piston 22 is slidably mounted within the lower piston housing 16 for longitudinal movement. A rigid, hollow, upper piston rod 24 extends downwardly from the upper piston 20 to contact the central portion of the upper surface of the lower piston 22. The abutment between the upper piston rod 24 and the upper central surface of the lower piston 22 can be by means of a loose fit into a cavity within the lower piston 22, as shown. The inner bore of a work string connected to the upper end of the tool 10 is in fluid flow communication with the upper surface of the upper piston 20. Simultaneously, the inner bore of the work string is in fluid flow communication with the upper surface of the lower piston 22 via the inner bore of the upper piston rod 24 and via one or more side ports 25 in the upper piston rod 24.

A rigid lower piston rod 26 extends downwardly from the lower piston 22, with the lower piston rod 26 being pinned to the lower piston housing 16 by one or more shear pins 28. A plurality of seals 30 provide a fluid seal between the upper piston 20 and the upper piston housing 14, between the upper piston rod 24 and the upper piston housing 14, and between the lower piston 22 and the lower piston housing 16. One or more bleed ports 32 are provided in the wall of the upper piston housing 14, connecting the interior of the upper piston housing 14 with the annulus surrounding the upper piston housing 14. The longitudinal placement of the bleed ports 32 is just above the longitudinal position where the upper piston 20 will reach substantially full travel in the downward direction.

Figure 2:
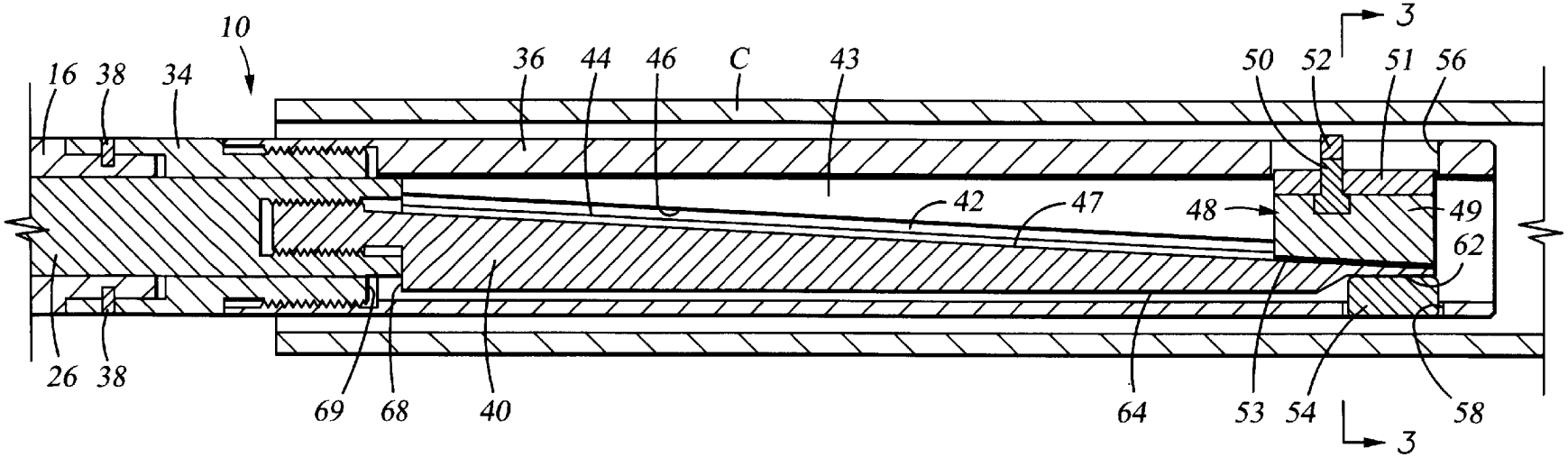
FIG. 2 is a longitudinal section view of the releasable sub and plunger housing of the tool shown in FIG. 1, using a shearable release sub.
Figure 3:
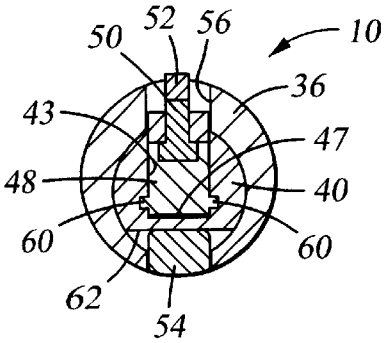
FIG. 3 is a transverse section view of the penetrator element and support dog of the tool shown in FIG. 2, before extension of the punch.

FIG. 2 shows a releasable sub 34 releasably attached to the lower end of the lower piston housing 16, and a plunger housing 36 attached to the lower end of the releasable sub 34. One or more shear pins 38 releasably attach the releasable sub 34 to the lower piston housing 16. The plunger housing 36 is shown positioned at a selected longitudinal position within a production tubing or casing C. A plunger 40 is fixedly attached to the lower end of the lower piston rod 26, for instance by means of threads as shown. As seen in FIGS. 2 and 3, a double faced ramp contour, in the form of at least one angled groove 42, is seen on the interior wall of a longitudinal channel 43 formed in the plunger 40. Each angled groove 42 includes an outwardly facing angled surface 44 and an inwardly facing angled surface 46. Further, the ramp contour includes the outwardly facing angled surface 47 at the bottom of the longitudinal channel 43.

A penetrator element 48 is slidably mounted for transverse movement in the lower end of the plunger housing 36. The penetrator element 48 can consist of a sliding block 49 within which is affixed a hard, durable punch 50. Various means known in the art can be used to affix the punch 50 to the sliding block 49, including the use of a retainer plate 51, which can be bolted to the sliding block 49. The punch 50 can be fitted with any of several different types of fittings 52, if desired, such as a marker tag, an orifice, or a check valve. This allows the fitting 52 to be left in the tubing or casing C after penetration by the punch 50. Alternatively, the punch 50 can be used simply to create a hole in the tubing or casing C.

A support dog 54 is mounted for transverse movement within the lower end of the plunger housing 36, substantially radially opposite the penetrator element 48. The penetrator element 48 slides in and out of a penetrator window 56 in the lower end of the plunger housing 36, and the support dog 54 slides in and out of a support dog window 58 in the lower end of the plunger housing 36. As best seen in FIG. 3, one or more ridges 60 are formed on the lateral sides of the penetrator element 48, with the ridges being formed at substantially the same angle as the grooves 42 in the plunger 40. The ridges 60 fit into and mate with the grooves 42. Further, the angled inside edge 53 of the penetrator element 48 abuts the angled surface 47 at the bottom of the longitudinal channel 43 in the plunger 40.

Figure 5:
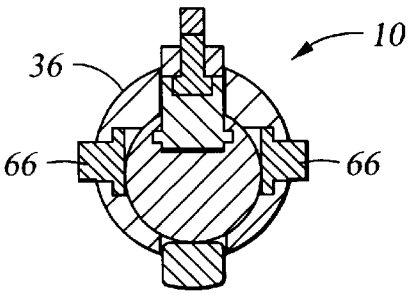
FIG. 5 is a transverse section view of the penetrator element and support dog of the tool shown in FIG. 2, showing optional side support dogs.
Figure 4:
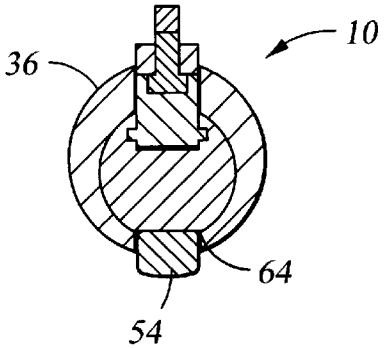
FIG. 4 is a transverse section view of the penetrator element and support dog of the tool shown in FIG. 2, after extension of the punch.

When the plunger 40 is at the upward limit of its travel as shown in FIGS. 2 and 3, the support dog 54 can rest entirely within the plunger housing 36, abutting an undercut surface 62 in the lower end of the plunger 40. In this position, the ridges 60 on the penetrator element 48 follow the grooves 42 on the plunger 40 to cause the penetrator element 48 to be at the inward limit of its transverse travel, fully withdrawn within the plunger housing 36. It can be seen in FIG. 4 that downward movement of the plunger 40 will cause the full diameter surface 64 of the plunger 40 to force the support dog 54 outward through the support dog window 58 to abut the casing C. Further, in this downward position of the plunger 40, the ridges 60 on the penetrator element 48 slide in the grooves 42 in the plunger 40 to cause the penetrator element 48 to move transversely outwardly to exit the plunger housing 36 through the penetrator window 56 and penetrate the casing C. As seen in FIG. 5, one or more additional support dogs 66 can be mounted peripherally around the plunger housing 36 to further stabilize the axial alignment of the hydraulic tubing punch tool 10 with the casing C.

Figure 6:
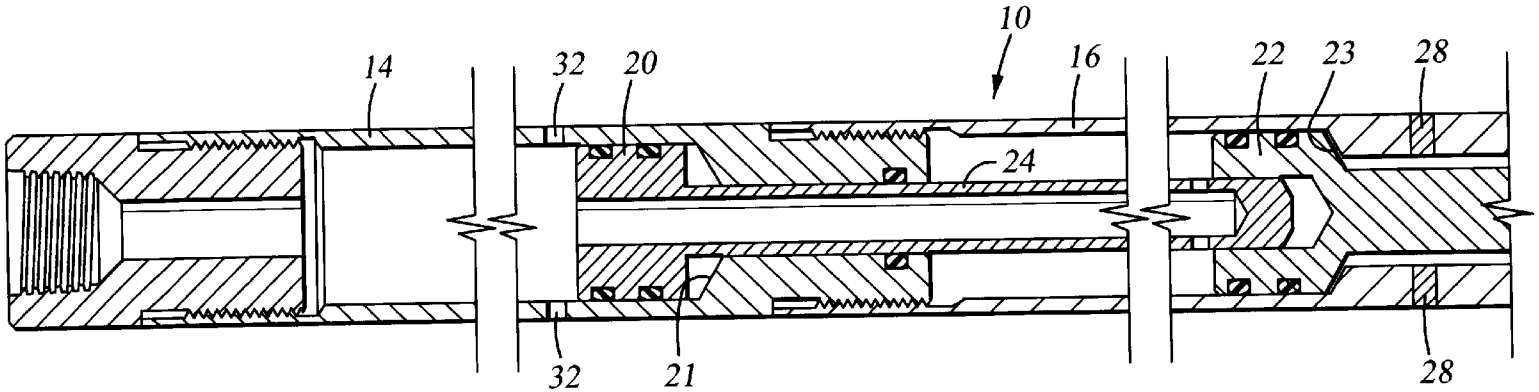
FIG. 6 is a longitudinal section view of the piston housing of the hydraulic tubing punch tool shown in FIG. 1, after full longitudinal travel of the drive assembly.

FIG. 6 shows the upper and lower pistons 20, 22 substantially at the lower limit of their longitudinal travel within the upper and lower piston housings 14, 16. When hydraulic pressure is increased to a predetermined value, the shear pins 28 shear, releasing the upper and lower pistons to move downwardly. The pressure level at which the shear pins 28 will shear can be designed to provide an initial impulse to the drive assembly, to facilitate penetration of the tubing or casing C. Upon substantially full downward travel of the upper piston 20, the bleed ports 32 are uncovered, allowing hydraulic pressure to bleed off from the interior of the upper piston housing 14 to the annulus surrounding the tool 10. This signals the operator that the upper piston 20 has reached substantially full longitudinal travel, and that, consequentially, the penetrator element 48 has reached substantially full transverse travel. Downward travel of the pistons 20, 22 can be stopped by abutment against seats 21, 23 in the piston housing 12. Alternatively, the size and number of the bleed ports 32 can also be designed to bleed off sufficient pressure to essentially stop the downward travel of the pistons 20, 22. The relative length of the upper piston rod 24 can be designed to allow the lower piston 22 to have some additional downward travel after the bleed ports 32 are uncovered by the downward travel of the upper piston 20.

Figure 8:
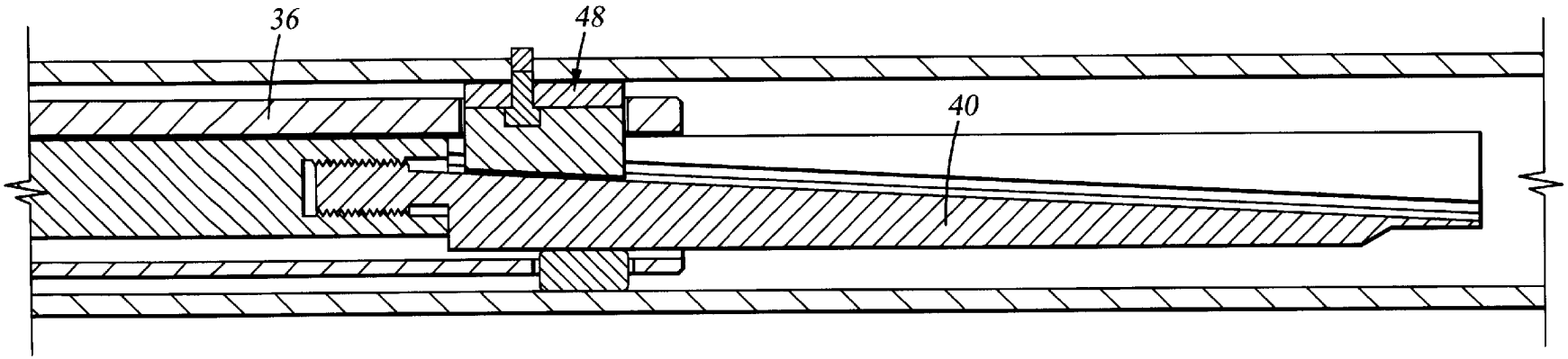
FIG. 8 is a longitudinal section view of the lower end of the plunger housing of the tool shown in FIG. 6, showing full downward extension of the plunger.
Figure 7:
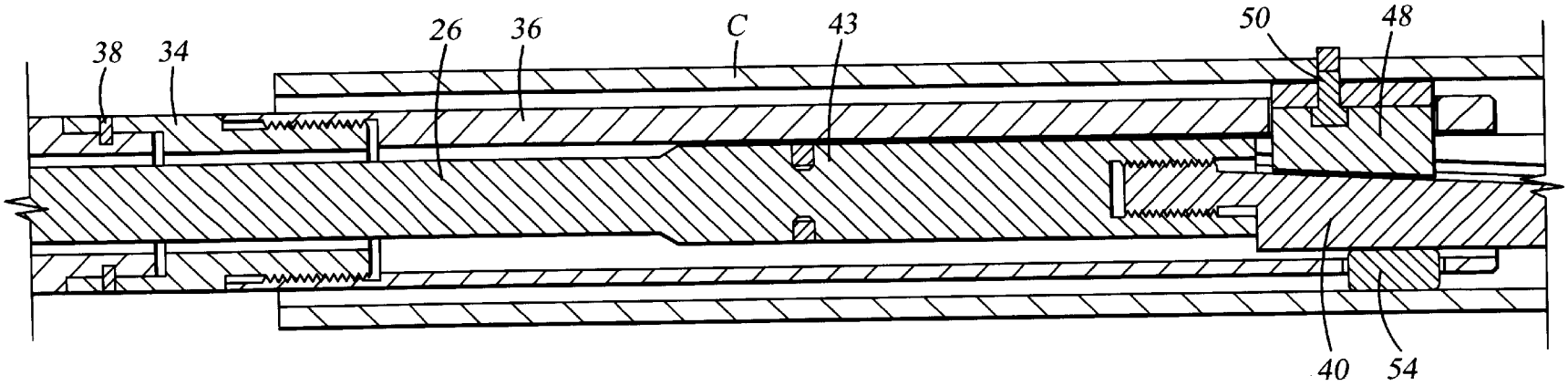
FIG. 7 is a longitudinal section view of the releasable sub and plunger housing of the tool shown in FIG. 6, showing full extension of the penetrator element.

FIG. 7 shows the plunger 40 substantially at the downward limit of its longitudinal travel, with the support dog 54 abutting the casing C for axial alignment, and with the penetrator element 48 having fully penetrated the casing C. FIG. 8 illustrates the extension of the lower end of the plunger 40 from the lower end of the plunger housing 36.

After the penetrator element 48 has fully penetrated the casing C, the operator can pull upwardly on the work string to shear the shear pins 38, thereby releasing the piston housing 12 from the releasable sub 34 and the plunger housing 36. During this shearing process, the upward pulling of the work string is resisted by the punch 50 of the penetrator element 48, which is extended into the casing C. After shearing of the shear pins 38 to release the releasable sub 34, the piston housing 12 moves upwardly, and the seat 23 abuts the lower piston 22 and pulls the pistons 20, 22, and the plunger 40 upwardly. As the plunger 40 is withdrawn longitudinally into the plunger housing 36, it can be seen that the plunger 40 will return to the position shown in FIG. 2, within the plunger housing 36. This withdraws the penetrator element 48 transversely into the plunger housing 36. When the punch 50 has withdrawn from the casing C, the upper end 68 of the plunger 40 can abut the lower end 69 of the releasable sub 34, to support the plunger housing 36 from the work string. The entire hydraulic tubing punch tool 10 can then be withdrawn from the well bore.

Figure 9:
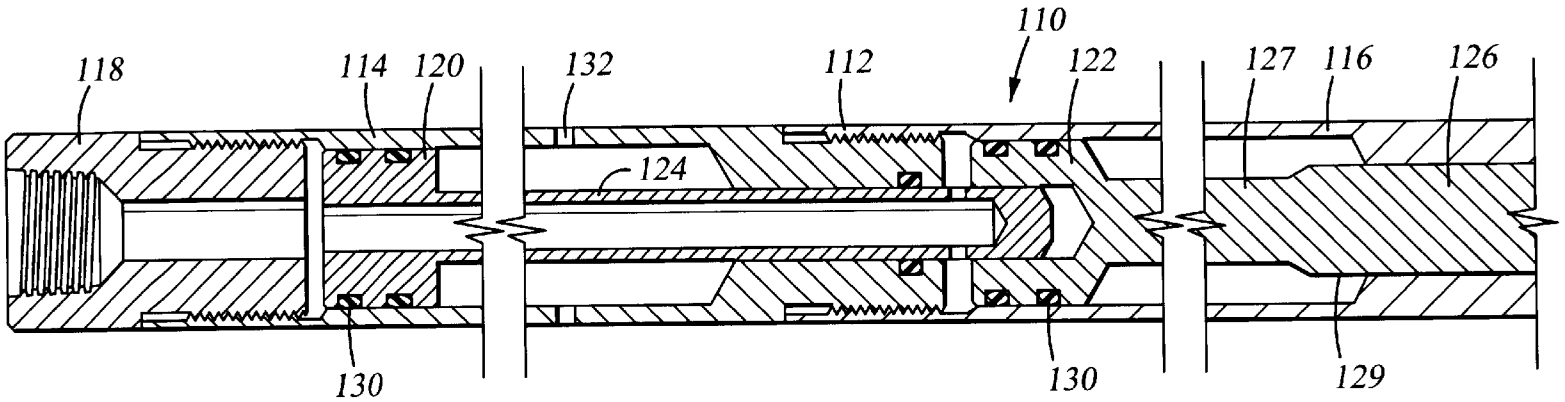
FIG. 9 is a longitudinal section view of the piston housing of a second embodiment of the hydraulic tubing punch tool of the present invention, before longitudinal travel of the drive assembly.

FIGS. 9 through 12 show a second embodiment of the hydraulic tubing punch tool 100, which utilizes a release dog 138, rather than the shear pins 38 used in the first embodiment, to release the piston housing 112 from the plunger housing 136. As seen in FIG. 9, the piston housing 112 consists of an upper piston housing 114 threaded to a lower piston housing 116. An upper connector sub 118 is threaded to the upper end of the upper piston housing 114, for connecting the hydraulic tubing punch tool 110 to a work string, such as a drill pipe or coiled tubing (not shown). An upper piston 120 is slidably mounted within the upper piston housing 114 for longitudinal movement. A lower piston 122 is slidably mounted within the lower piston housing 116 for longitudinal movement. A rigid, hollow, upper piston rod 124 extends downwardly from the upper piston 120 to contact the central portion of the upper surface of the lower piston 122.

A rigid lower piston rod 126, having an undercut portion 127 and a full diameter portion 129, extends downwardly from the lower piston 122. A plurality of seals 130 provide a fluid seal between the upper piston 120 and the upper piston housing 114, between the upper piston rod 124 and the upper piston housing 114, and between the lower piston 122 and the lower piston housing 116. One or more bleed ports 132 are provided in the wall of the upper piston housing 114, connecting the interior of the upper piston housing 114 with the annulus surrounding the upper piston housing 114.

Figure 10:
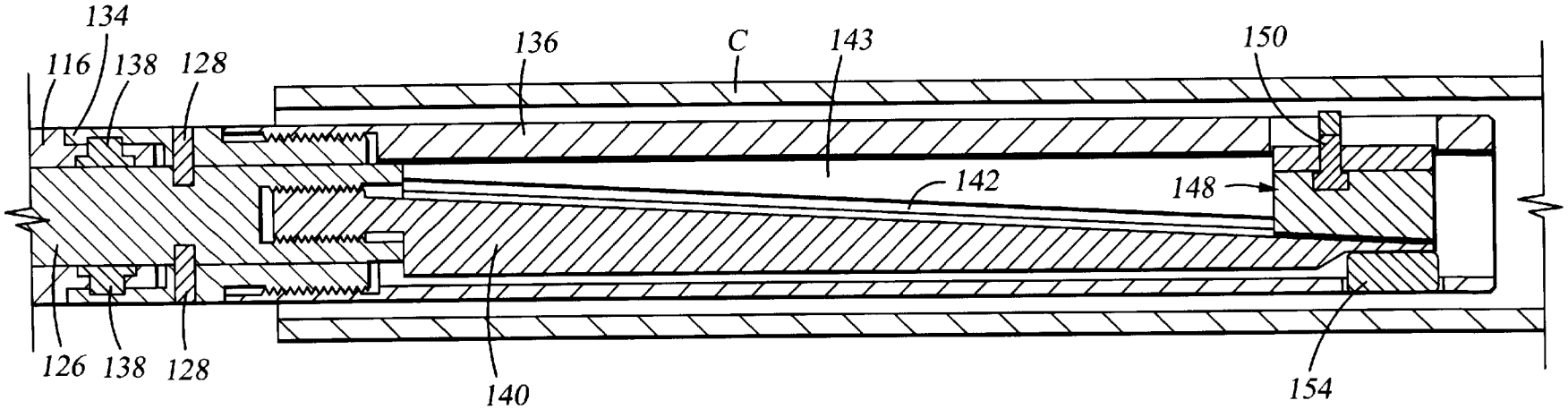
FIG. 10 is a longitudinal section view of the releasable sub and plunger housing of the tool shown in FIG. 9, using a release dog in the releasable sub.

FIG. 10 shows a releasable sub 134 releasably attached to the lower end of the lower piston housing 116, and a plunger housing 136 attached to the lower end of the releasable sub 134. The lower piston rod 126 is pinned to the releasable sub 134 by one or more shear pins 128. One or more release dogs 138 releasably attach the releasable sub 134 to the lower piston housing 16. The release dogs 138 are held in an outward position by abutment with the full diameter portion 129 of the lower piston rod 126, when the lower piston 122 is near the upward limit of its travel.

A plunger 140 is fixedly attached to the lower end of the lower piston rod 126. A double faced ramp contour, in the form of at least one angled groove 142, is seen on the interior wall of a longitudinal channel 143 formed in the plunger 140.

A penetrator element 148 is slidably mounted for transverse movement in the lower end of the plunger housing 136. The penetrator element 148 includes a hard, durable punch 150. A support dog 154 is mounted for transverse movement within the lower end of the plunger housing 136, substantially radially opposite the penetrator element 148.

Similarly to the first embodiment, one or more ridges are formed on the lateral sides of the penetrator element 148, with the ridges being formed at substantially the same angle as the grooves 142 in the plunger 140.

Figure 11:
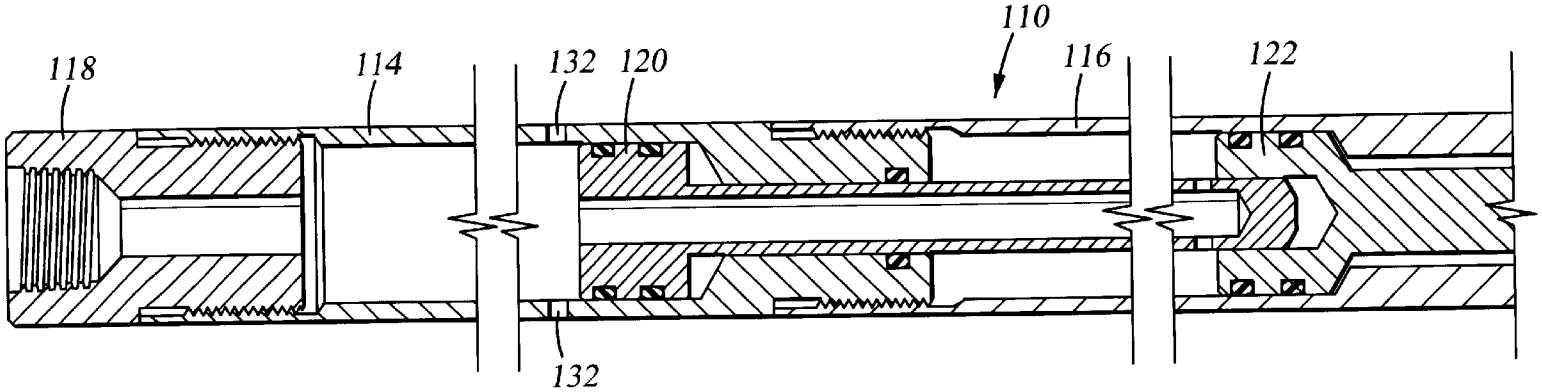
FIG. 11 is a longitudinal section view of the piston housing of the hydraulic tubing punch tool shown in FIG. 9, after full longitudinal travel of the drive assembly.

FIG. 11 shows the upper and lower pistons 120, 122 substantially at the lower limit of their longitudinal travel within the upper and lower piston housings 114, 116. When hydraulic pressure is increased to a predetermined value, the shear pins 128 shear, releasing the upper and lower pistons to move downwardly. Upon substantially full downward travel of the upper piston 120, the bleed ports 132 are uncovered, allowing hydraulic pressure to bleed off from the interior of the upper piston housing 114 to the annulus surrounding the tool 110.

Figure 12:
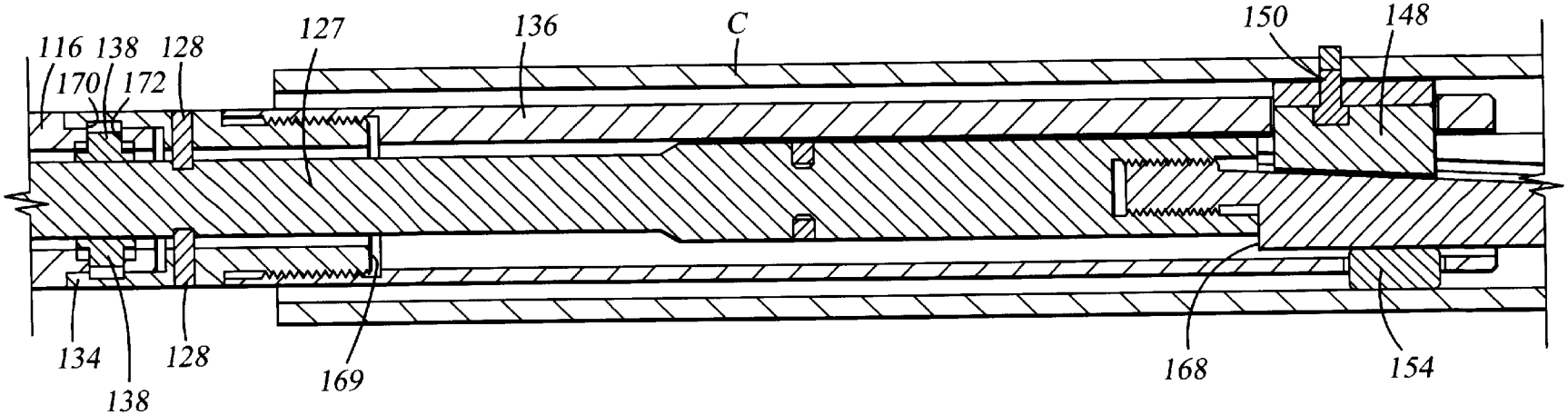
FIG. 12 is a longitudinal section view of the releasable sub and plunger housing of the tool shown in FIG. 11, showing full extension of the penetrator element.

FIG. 12 shows the plunger 140 substantially at the downward limit of its longitudinal travel, with the support dog 154 abutting the casing C for axial alignment, and with the penetrator element 148 having fully penetrated the casing C. The lower piston 122 has moved downward sufficiently to allow the release dogs 138 to fall into the undercut portion 127 of the lower piston rod 126, thereby withdrawing the outermost portion of the release dog 138 from the recess 170 in the releasable sub 134, into the hole 172 in the lower piston housing 116. This releases the releasable sub 134 from the piston housing 112.

After the penetrator element 148 has fully penetrated the casing C, the operator can pull upwardly on the work string to pull the piston housing 112 upwardly. This pulls the pistons 120, 122, and the plunger 140 upwardly. As the plunger 140 is withdrawn longitudinally into the plunger housing 136, it can be seen that the plunger 140 will return to the position shown in FIG. 10, within the plunger housing 136. This withdraws the penetrator element 148 transversely into the plunger housing 136. When the punch 150 has withdrawn from the casing C, the upper end 168 of the plunger 140 can abut the lower end 169 of the releasable sub 134, to support the plunger housing 136 from the work string. The entire hydraulic tubing punch tool 110 can then be withdrawn from the well bore.

Figure 13:
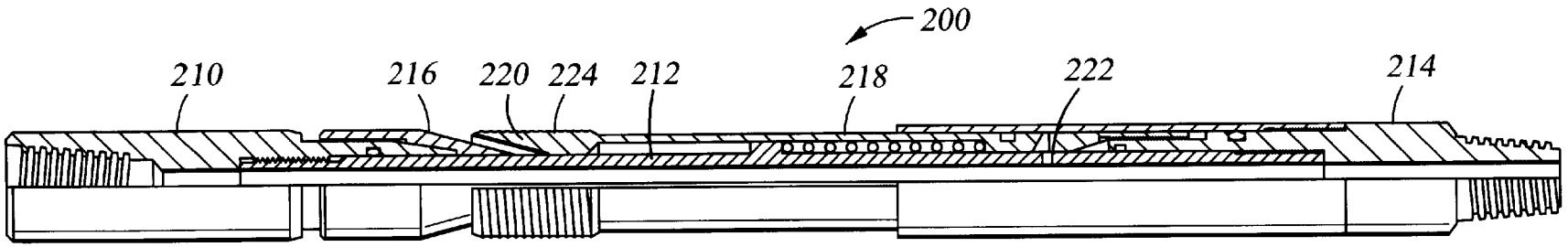
FIG. 13 is a longitudinal section of a hydraulically settable anchor mechanism for use with the present invention.

In order to assist in the actuation of the hydraulic tubing punch tool 10, 110 at any desired location in the casing C, an anchor mechanism can be used in conjunction with the tool. An example of such an anchor mechanism 200 is shown in FIG. 13. An upper connector sub 210 can be threadedly attached to the work string, and the hydraulic tubing punch tool 10, 110 can be threadedly attached to the lower connector sub 214. A hollow mandrel 212 is supported by the upper connector sub 210, with a drive cone 216 formed on or attached to the outer surface of the mandrel 212. A split finger collet 218 is slidably mounted on the outer surface of the mandrel 212, below the drive cone 216. A port 222 through the wall of the mandrel 212 provides fluid pressure from the work string to drive the collet 218 upwardly. A plurality of slip fingers 220 on the upper ends of the fingers of the collet 218 are driven outwardly by contact with the drive cone 216. This forces the slip teeth 224 on the outer surfaces of the slip fingers 220 to forcibly contact the casing C, holding the anchor mechanism 200 and the tubing punch 10, 110 in position.

The same hydraulic pressure that sets the anchor mechanism 200 can actuate the tubing punch 10, 110. After full travel of the drive assembly and the penetrator element 48, 148, pulling upwardly on the work string will cause the drive cone 216 to withdraw from contact with the slip fingers 220, releasing the anchor mechanism 220. Thereafter, continued upward pulling on the work string withdraws the penetrator element 48, 148 from the casing C, as described above.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for punching an opening in a downhole tubular element in a well bore, said apparatus comprising:

a housing adapted to be connected at its upper end to a work string for placement within a tubular element in a well bore;

a drive assembly slidably mounted to said housing for bi-directional longitudinal travel, said drive assembly being adapted to be selectively driven longitudinally relative to said housing by application of hydraulic pressure to said drive assembly;

a pressure limiting device on said apparatus for substantially limiting hydraulic pressure applied to said drive assembly, said pressure limiting device being actuated by substantially full travel of said drive assembly during said hydraulically driven longitudinal travel;

a ramp formed along said drive assembly for bi-directional longitudinal travel with said drive assembly, said ramp being angled relative to the longitudinal axis of said housing; and a penetrator element mounted for transverse motion relative to said housing;

wherein said ramp is adapted to move said penetrator element in bi-directional transverse motion relative to said housing, as said ramp moves in bi-directional longitudinal travel, to cause an outer end of said penetrator element to selectively penetrate, and withdraw from, a tubular element within which said housing is placed.

2. An apparatus as recited in claim 1, further comprising a release mechanism releasably connecting said housing to the work string, wherein:

said drive assembly is slidably connected to the work string for partial longitudinal withdrawal of said drive assembly from said housing by pulling on the work string, after releasing of said release mechanism; and said ramp is adapted to withdraw said penetrator element transversely into said housing as said drive assembly is partially withdrawn longitudinally from said housing.

3. An apparatus as recited in claim 2, wherein said release mechanism comprises a shear sleeve, said shear sleeve being released by pulling on the work string.

4. An apparatus as recited in claim 2, wherein said release mechanism comprises a release dog, said release dog being released upon substantially full travel of said drive assembly during said hydraulically driven longitudinal travel of said drive assembly.

5. An apparatus as recited in claim 1, further comprising at least one piston formed on said drive assembly; and a release mechanism;

wherein:

said housing comprises an upper housing adapted to be connected to a work string, and a lower housing releasably connected by said release mechanism to said upper housing;

said at least one piston is mounted within said upper housing;

said ramp is mounted within said lower housing;

said penetrator element is mounted to said lower housing;

said at least one piston is slidably retained to said upper housing for partial longitudinal withdrawal of said drive assembly from said lower housing by pulling on the work string, after releasing of said release mechanism; and said ramp is adapted for transverse withdrawal of said penetrator element into said lower housing as said drive assembly is partially withdrawn longitudinally from said lower housing.

6. An apparatus as recited in claim 5, wherein said release mechanism comprises a shear sleeve, said shear sleeve being released by pulling on the work string.

7. An apparatus as recited in claim 5, wherein said release mechanism comprises a release dog, said release dog being released upon substantially full travel of said drive assembly during said hydraulically driven longitudinal travel of said drive assembly.

8. An apparatus as recited in claim 1, further comprising an upper piston and a lower piston formed on said drive assembly, each said piston being adapted to be driven longitudinally within said housing by application of hydraulic pressure to said respective piston, said upper piston being adapted to apply mechanical force via an upper piston rod to a portion of said lower piston, to boost the total force developed by said drive assembly.

9. An apparatus as recited in claim 1, wherein said pressure limiting device comprises a bleed port in said housing, said bleed port being longitudinally located so as to be uncovered by substantially full travel of said drive assembly, resulting in a drop in hydraulic pressure, thereby signalling full travel of said penetrator element.

10. An apparatus as recited in claim 1, further comprising an anchor mechanism mounted to said housing, said anchor mechanism being adapted to anchor said housing at any selected location within a tubular element in the well bore.

11. An apparatus as recited in claim 1, further comprising:

at least one support dog mounted to said housing; and a second ramp on said drive assembly, said second ramp being adapted to extend said support dog transversely from said housing upon longitudinal travel of said drive assembly, to maintain said housing in a selected axial alignment with the tubular element to be penetrated.

12. An apparatus as recited in claim 11, wherein said at least one support dog is mounted substantially radially opposite from said penetrator element.

13. An apparatus as recited in claim 11, further comprising a plurality of said support dogs mounted circumferentially around said housing.

14. An apparatus as recited in claim 1, further comprising mating contours formed on said ramp and said penetrator element, said mating contours having both radially inwardly facing surfaces and radially outwardly facing surfaces, thereby allowing said ramp to apply radially outward force to said penetrator element as said drive assembly travels in a first longitudinal direction, and allowing said ramp to apply radially inward force to said penetrator element as said drive assembly travels in a second longitudinal direction.

15. An apparatus as recited in claim 14, wherein:

said ramp comprises at least one groove formed along said drive assembly, said at least one groove being angled relative to the longitudinal axis of said housing; and said penetrator element comprises at least one ridge sized and shaped to mate with said at least one groove on said ramp, said at least one ridge being formed at substantially the same angle as said at least one groove.

16. An apparatus as recited in claim 1, further comprising a fitting releasably mounted on said penetrator element, said fitting being adapted to release from said penetrator element upon withdrawal of said penetrator element from said tubular element, thereby leaving said fitting in said tubular element.

17. An apparatus as recited in claim 16, wherein said fitting comprises a marker tag.

* * * * *